US006161711A

United States Patent [19]

Miceli et al.

[11] Patent Number: 6,161,711

[45] Date of Patent: Dec. 19, 2000

[54] CONTAINER AND CLOSURE SYSTEM

[75] Inventors: David A. Miceli; Joseph A. Miceli, both of Spencer, Tenn.

[73] Assignee: Tri State Distribution, Inc., Spencer, Tenn.

[21] Appl. No.: 09/233,057

[22] Filed: Jan. 20, 1999

Related U.S. Application Data

[60] Provisional application No. 60/071,966, Jan. 20, 1998, and provisional application No. 60/108,888, Nov. 17, 1998.

[51] Int. Cl.[7] ..... A61J 1/00

[52] U.S. Cl. ..... 215/206; 215/211; 215/224; 215/228; 215/246; 215/320; 215/349

[58] Field of Search ..... 215/206, 211, 215/224, 228, 230, 246, 319, 320, 325, 349

[56] References Cited

U.S. PATENT DOCUMENTS

| | | | |
|---|---|---|---|
| D. 374,821 | 10/1996 | Johnson . | |
| 3,399,796 | 9/1968 | Steiner . | |
| 3,445,022 | 5/1969 | Cilluffo . | |
| 3,627,160 | 12/1971 | Horvath . | |
| 3,669,295 | 6/1972 | Horvath . | |
| 3,690,495 | 9/1972 | Turner . | |
| 3,782,574 | 1/1974 | Rumble . | |
| 3,812,989 | 5/1974 | Horvath . | |
| 3,865,267 | 2/1975 | Morris | 215/206 |
| 3,871,662 | 3/1975 | Hepp et al. . | |
| 3,907,145 | 9/1975 | Horvath . | |
| 4,011,960 | 3/1977 | Mauvernay et al. . | |
| 4,071,156 | 1/1978 | Lowe . | |
| 4,087,016 | 5/1978 | Towns et al. . | |
| 4,095,718 | 6/1978 | Kong . | |
| 4,103,797 | 8/1978 | Morris . | |
| 4,105,132 | 8/1978 | Keeler . | |
| 4,117,945 | 10/1978 | Mumford . | |
| 4,223,794 | 9/1980 | Morris . | |
| 4,271,971 | 6/1981 | Morris . | |
| 4,281,771 | 8/1981 | Siegel . | |
| 4,285,437 | 8/1981 | Morris . | |
| 4,346,809 | 8/1982 | Kusz . | |
| 4,375,859 | 3/1983 | Fillmore . | |
| 4,406,376 | 9/1983 | Berghahn . | |
| 4,413,742 | 11/1983 | Sandhaus . | |
| 4,433,789 | 2/1984 | Gibilisco . | |
| 4,511,051 | 4/1985 | Desai . | |
| 4,520,938 | 6/1985 | Finke . | |
| 4,526,281 | 7/1985 | Herr | 215/211 |
| 4,613,051 | 9/1986 | Swartzbaugh . | |
| 4,669,620 | 6/1987 | Coifman . | |
| 4,687,112 | 8/1987 | Swartzbaugh . | |
| 4,694,968 | 9/1987 | Proctor et al. | 215/224 |
| 4,729,487 | 3/1988 | Wright . | |
| 4,752,013 | 6/1988 | Miller et al. . | |
| 4,752,014 | 6/1988 | House et al. . | |
| 4,782,976 | 11/1988 | Kenyon, 2nd | 215/246 X |
| 4,832,218 | 5/1989 | Gibilisco . | |
| 4,854,459 | 8/1989 | DeJonge . | |
| 4,998,632 | 3/1991 | Morris, Sr. . | |
| 5,115,928 | 5/1992 | Drummond, Jr. . | |
| 5,234,118 | 8/1993 | Fillmore et al. . | |
| 5,372,267 | 12/1994 | Hofmann . | |
| 5,449,077 | 9/1995 | Seidler . | |
| 5,460,281 | 10/1995 | Rapchak et al. . | |

(List continued on next page.)

FOREIGN PATENT DOCUMENTS

| | | |
|---|---|---|
| 2 471 329 | 6/1981 | France . |
| 25 33 230 | 2/1977 | Germany . |
| 2 182 649 | 5/1987 | United Kingdom . |
| WO 90/04546 | 5/1990 | WIPO . |

*Primary Examiner*—Stephen K. Cronin
*Attorney, Agent, or Firm*—Shanks & Herbert

[57] ABSTRACT

A closure and container system for storing prescription or over-the-counter medications is disclosed that is reversible between child-resistant and non-child resistant modes of use. The system includes a pair of endless beads, one on each of the container neck and closure, to improve moisture-barrier protection.

24 Claims, 21 Drawing Sheets

U.S. PATENT DOCUMENTS 5,544,770 8/1996 Travisano ..... 215/230
5,579,933 12/1996 Hofmann .
5,603,421 2/1997 Opresco .
5,636,756 6/1997 Johnson .
5,671,853 9/1997 Herr .
5,687,863 11/1997 Kusz .
5,706,963 1/1998 Gargione .
5,722,546 3/1998 Briere .
5,899,348 5/1999 Konefal et al. ..... 215/209

CONTAINER AND CLOSURE SYSTEM

CROSS REFERENCE TO RELATED APPLICATIONS

This application claims the benefit of U.S. provisional patent application Ser. No. 60/071,966, filed on Jan. 20, 1998, for "Closure Cap and Vial System," and of U.S. provisional patent application Ser. No. 60/108,888, filed on Nov. 17, 1998, for "Improved Closure Cap and Vial System," the contents of both being hereby incorporated by reference.

BACKGROUND OF THE INVENTION

1. Field of Invention

The invention relates to child-resistant closure and container systems. Specifically, the invention relates to a plastic vial and child-resistant cap systems especially adapted for storage of moisture sensitive materials, such as pharmaceuticals and other chemicals, that are both child-resistant and easier for adults to open than currently available designs.

2. Background Information

Child-resistant closures for moisture-sensitive materials, such as prescription and over-the-counter drugs, are known. One prior art child-resistant closure system is known as the Calmar design. The Calmar cap includes a skirt on the inside of which is an annular groove which snaps over a corresponding annular bead on the container's neck finish. The neck bead does not extend around the entire circumference of the neck, thereby defining a gate opening. Child-resistance is provided by a gate and a pair of locking lugs on the skirt which fit underneath the neck finish bead. To open the container, the cap is rotated so that the gate is aligned with the gate opening. A thumb tab on the outside of the cap indicates the location of the gate. An alignment reference mark on the container indicates the location of the gate opening.

The Calmar design suffers from several shortcomings. Specifically, in order to provide an adequate moisture barrier, the neck and cap groove are designed to interfit each other so tightly that the resulting friction excessively impedes rotation of the cap. As a result, opening the package requires firm grasping of the closure. Rotation of the cap is oftentimes very onerous, especially for arthritis sufferers. Making the cap and closure tolerances so tight as to provide an adequate moisture barrier also makes snapping the cap back in place difficult, thereby adding to the user's discomfort. Furthermore, aligning the thumb tab with the alignment reference mark is often difficult for visually impaired persons due to the small size of the thumb tab relative to the size of the cap. Finally, because the thumb tab is small and made from a hard, stiff plastic, significant pressure must sometimes be applied to the tab once the cap and container are aligned in order to pop the cap off the container. Application of this much pressure will sometimes be painful and sometimes leave a temporary impression of the tab in the user's finger. Accordingly, aligning and lifting the cap can be a frustrating and sometimes painful ordeal at a time when pain relief is desired most. Therefore, there is a need for a design which overcomes these shortcomings.

There is also a need for a one-piece easy-to-use closure which is both child-resistant and non-child resistant to accommodate both the need for children's safety and the convenience of adult consumers in situations in which children are not at risk of being harmed by the container contents. As noted above, one deficiency of currently available child-resistant container and closure systems is the difficulty that even adults face when attempting to open a child-resistant container.

The foregoing drawbacks have contributed to the gradual decrease in popularity of the Calmar system of child-resistant packaging in favor of more expensive systems, such as torque-actuated continuous threaded closures. Furthermore, implementation of proposed Consumer Product Safety Commission standards requiring that all chil-dresistant packaging also be "senior friendly" are expected to lead to further decreases in the popularity of the Calmar finish.

There also continues to be a need for tamper-evident packaging that accommodates two independent indicators of tampering. Two preferred indicators are a film barrier seal across the mouth of the container and a close-fitting shrink-wrap type plastic film over the closure and container.

These and other unmet needs in the art are satisfied by one or more exemplary embodiments of the invention disclosed herein.

SUMMARY OF THE INVENTION

It is, therefore, a principle object of the invention to provide a child-resistant container and closure system providing the container contents with good moisture barrier protection.

It is another object of the invention to provide a child-resistant container and closure system that can be opened by an adult more easily than current Calmar type systems.

It is another object of the invention to provide a one-piece reversible child-resistant/non-child-resistant container and closure system.

It is another object of the invention to provide a tamper-evident child-resistant container and closure system that accommodates two independent indicators of tampering.

It is another object of the invention to provide a container and closure system that solves the above-mentioned problems related to moisture control, child-resistance, reversibility between child-resistant and non-child resistant modes, convenience, tamper-evidence, and/or ease-of-use by adults.

These and other objects of the present invention are accomplished by the exemplary container and closure systems having the structural attributes disclosed herein.

According to one aspect of the invention, an exemplary container and closure system may include at least two mating pairs of annular beads on the container neck and closure. One annular bead may be provided on an outer skirt depending downwardly from the top of the closure. Another annular bead may be provided on an inner downwardly depending skirt of the closure at a smaller radial distance from the center of the closure. Two corresponding annular beads may be provided on the neck finish of the container.

According to another aspect of the invention, an exemplary closure may include a thumb tab that is larger and easier to find and use than that of the prior art Calmar design.

Yet another aspect of the invention relates to an exemplary closure that may be made from high density polyethylene or other material that is more yielding to manual pressure during removal of the closure than the polypropylene materials currently in use.

According to yet another aspect of the invention, an exemplary closure is preferably of one-piece construction including a child-resistant (CR) side and a non-child-resistant (NCR) side. The NCR side preferably includes a non-child resistant annular bead which fits within the mouth region of the container neck.

Still another aspect of the invention relates to an exemplary closure having a child-resistant side which in use preferably does not enter the mouth region of the container neck. This feature allows the container contents to be added to the container, and a tamper evident sealing film provided over the container mouth. The closure may then be applied to the at least partially filled container, and a shrink-wrap film-type tamper-evident indicator may be applied over the closure and container before distribution of the package.

These and other aspects of the invention will become apparent from the detailed discussion set forth below.

DETAILED DESCRIPTION OF THE PREFERRED EMBODIMENTS

Figure 1:
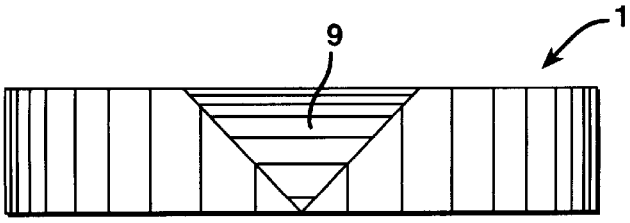
FIG. 1 is a view of the front exterior of the first embodiment of the child-resistant cap of the instant invention.
Figure 2:
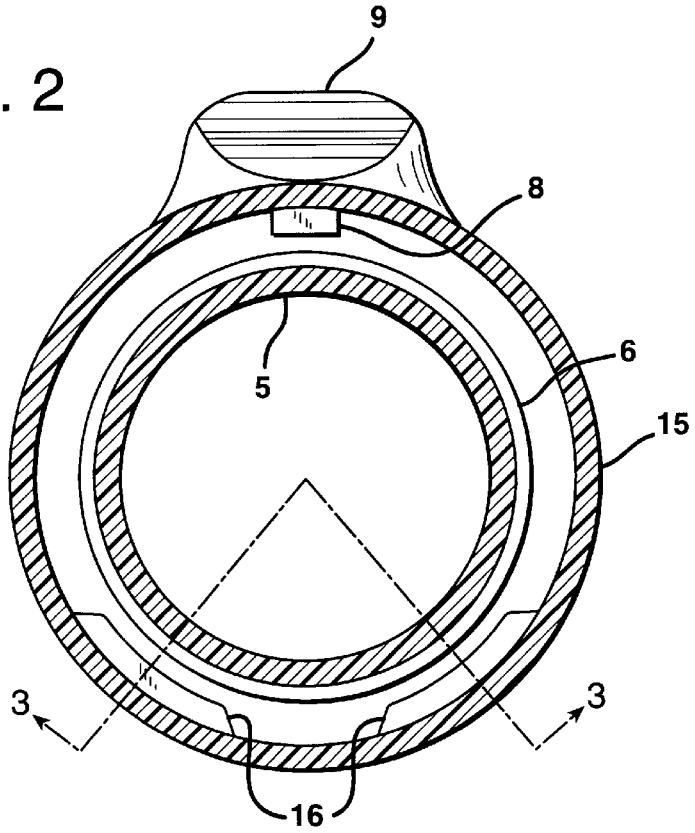
FIG. 2 is a view of the bottom of the cap shown in FIG. 1.
Figure 3:
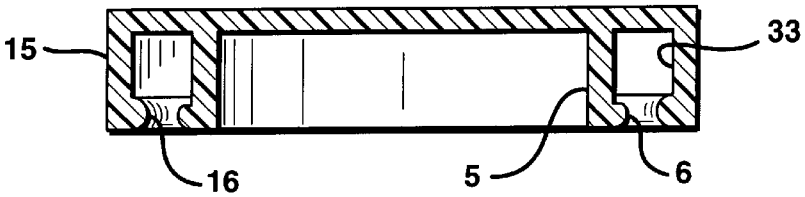
FIG. 3 is a section view of the cap of FIG. 2 taken along line 3—3.
Figure 4:
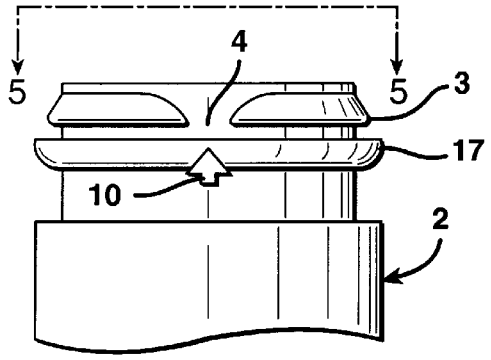
FIG. 4 is a view of the exterior of the vial neck region showing the registration mark of the instant invention.
Figure 5:
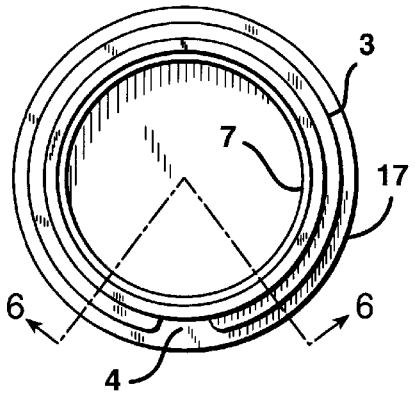
FIG. 5 is a view of the vial shown in FIG. 4 taken along line 5—5.
Figure 6:
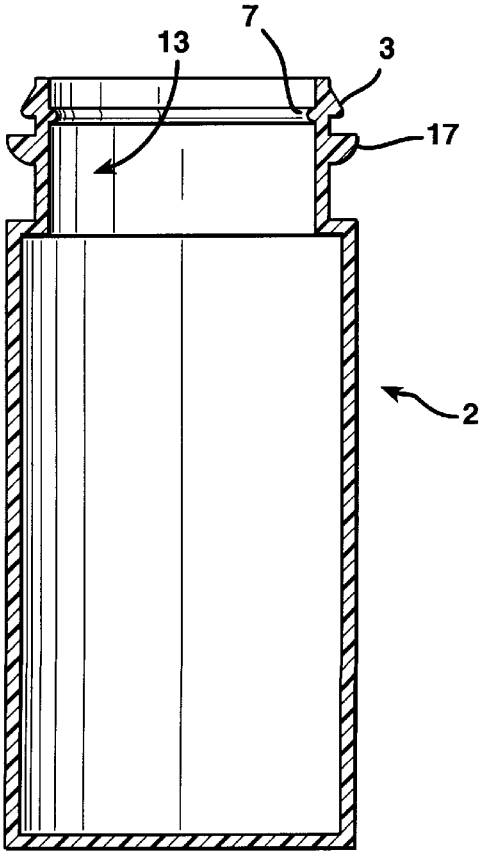
FIG. 6 is a section view of the vial of FIG. 5 taken along line 6—6.
Figure 7:
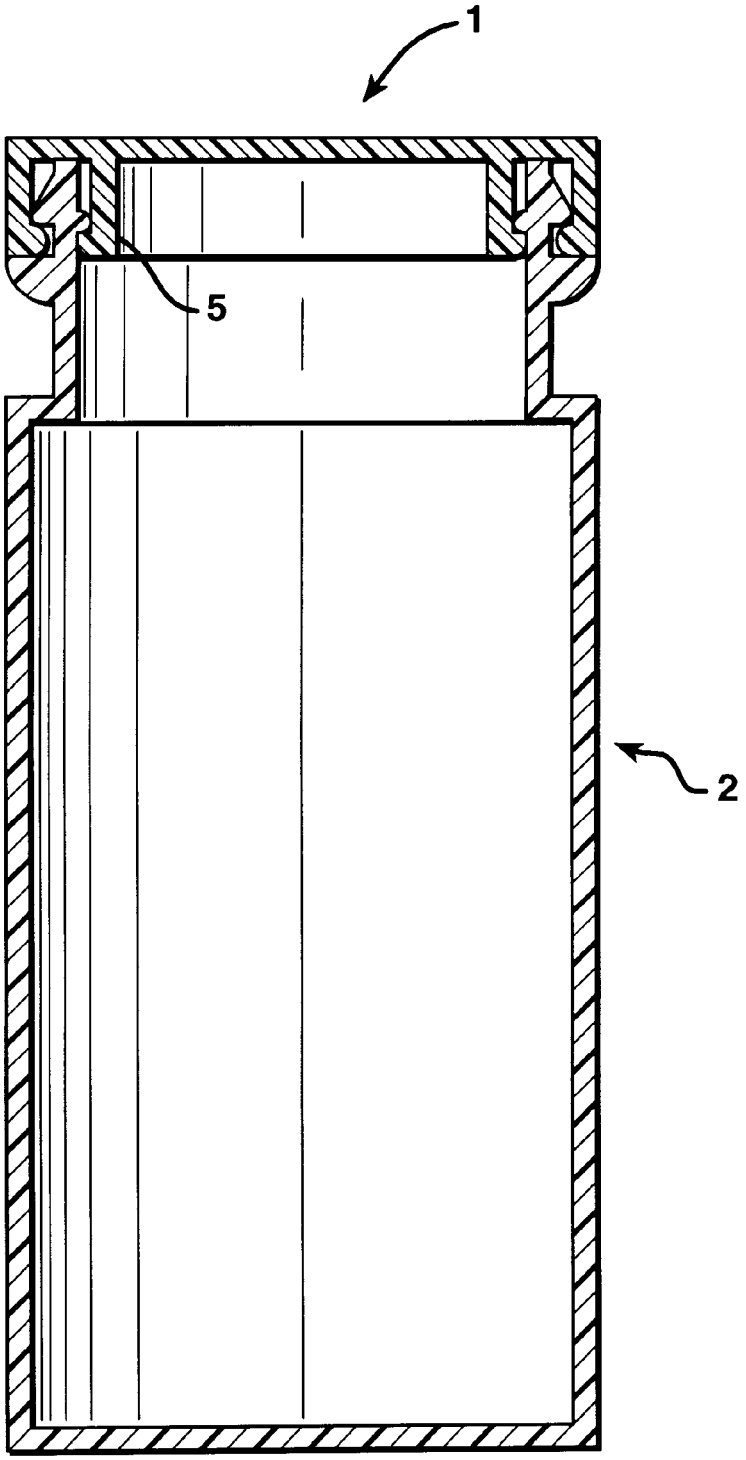
FIG. 7 is a section view of the FIG. 1 cap and FIG. 6 vial in the closed child resistant position (taken along a line similar to 3—3 and 6—6).

Several embodiments of the closure are described below, as are several embodiments of the vial. The first, second, and third embodiments of the vial are structurally the same. Each of the first, second and third embodiments of the closure can be used together with the first embodiment of the vial.

FIGS. 1–9 show the first embodiment of the closure and the first embodiment of the vial. The first embodiment of the closure is a child-resistant closure 1. Preferably, the closure 1 is a one-piece, integrally formed cap that is linerless. The closure 1 is preferably molded from HDPE (high density polyethylene) rather than from harder and less resilient polypropylene. Using HDPE produces a cap that is more flexible and softer on the hands and fingers of the users. Accordingly, it is more user-friendly than caps made from polypropylene. Using HDPE, the closure and container system results in a better "feel" since the cap can be made from a softer resin.

The closure 1 preferably includes outer skirt 15 and locking lugs 16. The vial may include vial flange 17. The closure may include a pair of endless annular beads to form a moisture barrier. The vial neck may include an outer bead 3 which interfits with gate 8 and locking lugs 16 to retain the cap on the vial neck. The cap may be rotated on the vial to align gate 8 with the radial bead opening 4 (a.k.a., gate opening) for removing the cap.

The first, second, and third embodiments of the closure preferably use an inner skirt 5 designed to fit snugly inside, i.e., at a smaller radius than, the neck of the container with a small annular inner skirt bead 6 located preferably near the bottom of the inner skirt 5. This inner skirt bead 6 may engage an inner annular neck bead 7 forming an integral part of the neck finish. Preferably, the inner annular neck bead is located just above the height at which the inner skirt bead 6 comes to rest once the cap is seated properly. The user may both feel and hear an audible "click" when the cap is snapped into place as the inner skirt bead 6 moves over the inner annular neck bead before seating itself in the neck of the bottle. The snug fit of the supple HDPE inner skirt bead inside the vial neck contributes to providing moisture barrier protection.

The inner skirt bead may eliminate the need for supplemental cap liners which have been used in the past to provide moisture protection. These liners are both expensive and cumbersome to cut and insert within the existing cap designs. It is expected that the closures disclosed herein will make the use of these supplemental liners unnecessary. Moisture barrier protection is preferably provided by a first pair of sealing surfaces, e.g., inner annular neck bead 7 and inner skirt bead 6, provide a moisture barrier. The cap and vial tolerances may be adjusted to allow the cap to rotate smoothly without requiring excessive force and without compromising protection from moisture. An additional optional moisture barrier may be provided for any of the embodiments described below by shrink-wrap type film 38 applied around the cap/vial juncture, as shown for example in FIG. 29A and FIG. 29B.

In this disclosure, the term "annular" means "along an arc at a fixed radius from a central axis." Annular beads may extend completely around a central axis. Inner skirt bead 6 and inner annular neck bead 7 are shown, for example, in FIG. 2 and FIG. 3 extending completely around the central axes of the closure and vial, respectively. Annular beads may also extend only partially along an arc, such as locking lugs 16, gate 8, or outer neck bead 3.

The first embodiment cap of this invention may also feature a new tab design.

Thumb tab 9, located at the top of the outside circumference of the cap, is a high profile design. The tab may extend radially outwardly from the body portion of the closure a distance of about 2–6 mm, preferably about 4 mm. The tab may extend along the circumference of the closure body about 4–15 mm, preferably about 6 mm. when grasping the container with one hand, the tab is intended to function as a tool to help the user rotate the closure without undue force, and to remove the cap through improved leverage. The cap is also designed to provide a larger, more easily visible reference 10 to help the user align the cap in the proper position so it can be removed. This improvement is expected to eliminate problems with current designs that leave users frustrated when attempting to open the package but have difficulty seeing the indexing marks on the cap and vial.

Figure 8:
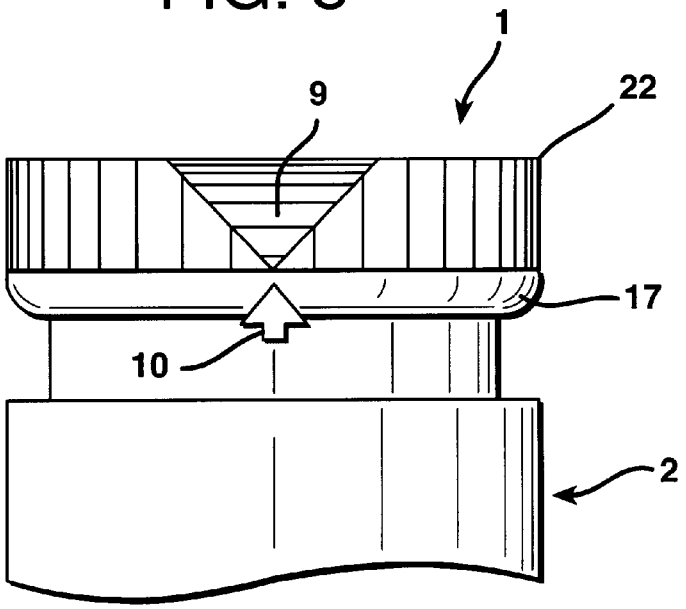
FIG. 8 is a front view of the child resistant cap and vial system in the closed position.
Figure 9:
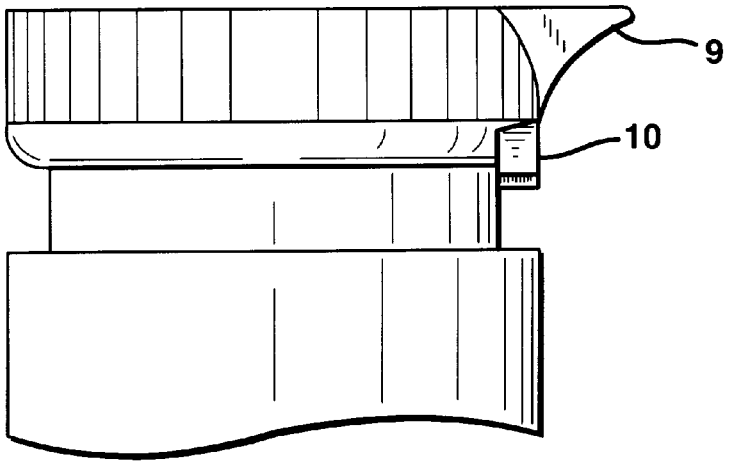
FIG. 9 is a side view of the system of FIG. 8.
Figure 10:
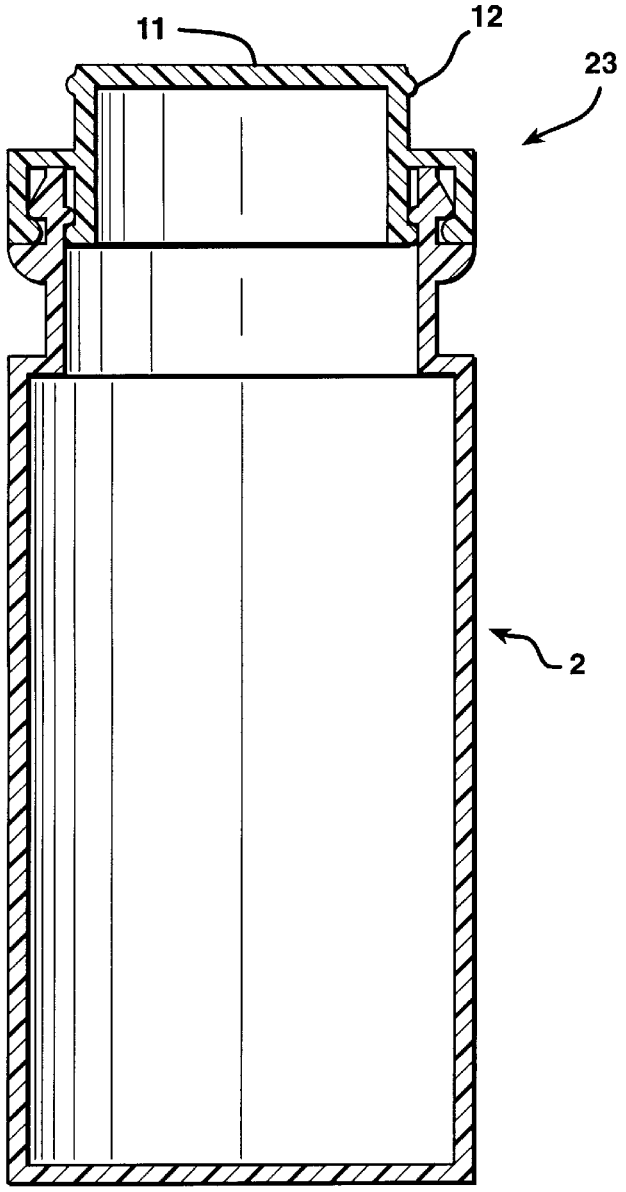
FIG. 10 is a section view of the second embodiment of the reversible child-resistant and non-child resistant cap and vial in the closed child resistant position (taken along a line similar to 3—3 and 6—6).

In FIG. 8 and FIG. 9, the cap is not in the locked, child-resistant position since the gate 8 and gate opening 4 are in alignment. However, by simply rotating the cap in either direction such that the gate and gate opening are out of alignment, a child resistant configuration can be attained. Insofar as the tab is preferably adjacent to the gate, and the reference mark 10 is preferably adjacent to the gate opening, a child resistant configuration can be attained by simply rotating the cap in either direction such that the tab and reference mark are out of alignment.

For all embodiments, the term "non-locking orientation" means the closure is oriented about its rotational axis 18 with respect to the gate opening 4 of the vial neck finish such that the closure can be removed from the vial.

The second, third, fourth, fifth, and sixth embodiments preferably are reversible between a CR and a NCR configuration. The term "CR configuration" means the CR side of the closure mates with the neck of the vial. Likewise, the term "NCR configuration" means the NCR side of the closure mates with the neck of the vial.

FIGS. 10–15 show the second embodiment. The second embodiment includes a cylindrical dome 11 on top of the closure 23. The side of the second embodiment closure having the dome is the NCR side of the closure. By inserting the NCR side of the closure into the mouth of the container and pressing the retaining bead 12 below the inner annular neck bead 7, a non-child resistant configuration of the closure and vial system is attained.

Figure 11:
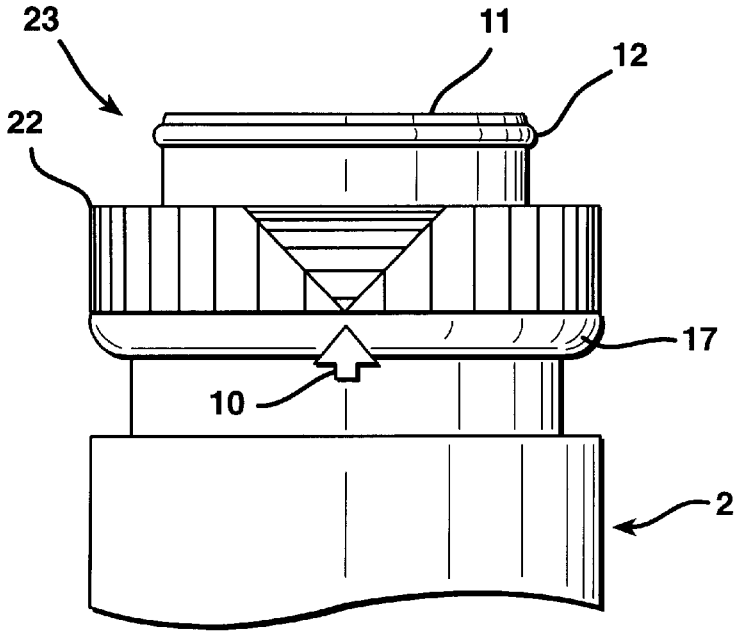
FIG. 11 is a front view of the second embodiment of the reversible child-resistant and non-child resistant cap and vial system in the closed position.
Figure 12:
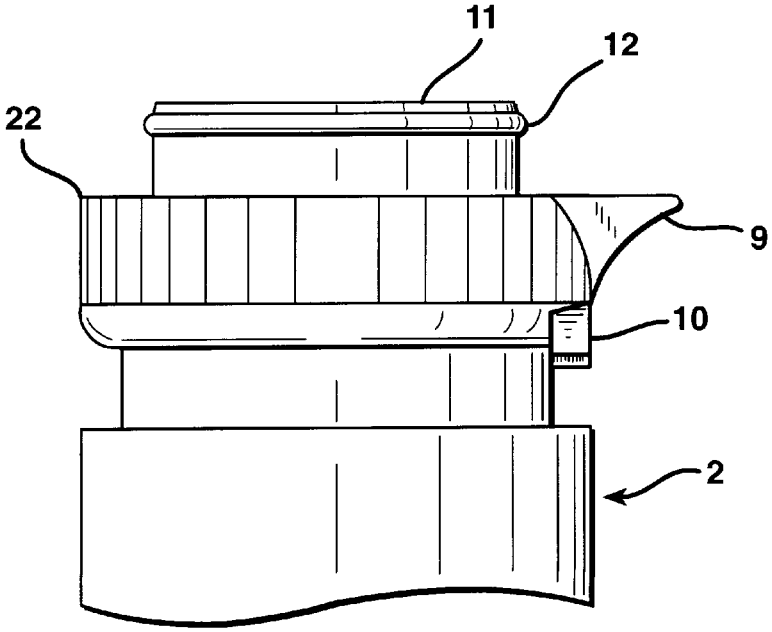
FIG. 12 is a side view of the system of FIG. 11.
Figure 13:
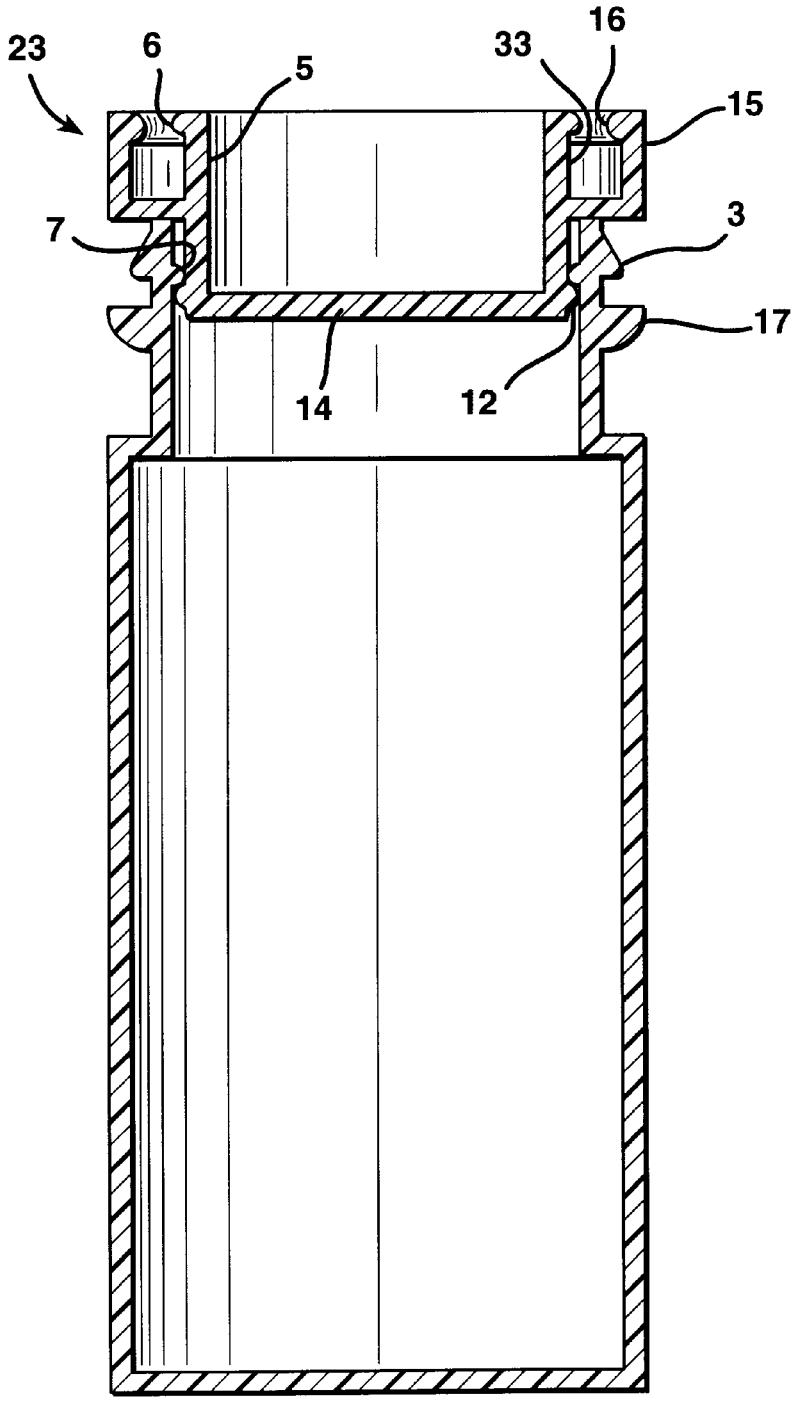
FIG. 13 is a section view of the second embodiment of the reversible child-resistant and non-child resistant cap and vial in the inverted or non-child resistant position (taken along a line similar to 3—3 and 6—6).
Figure 14:
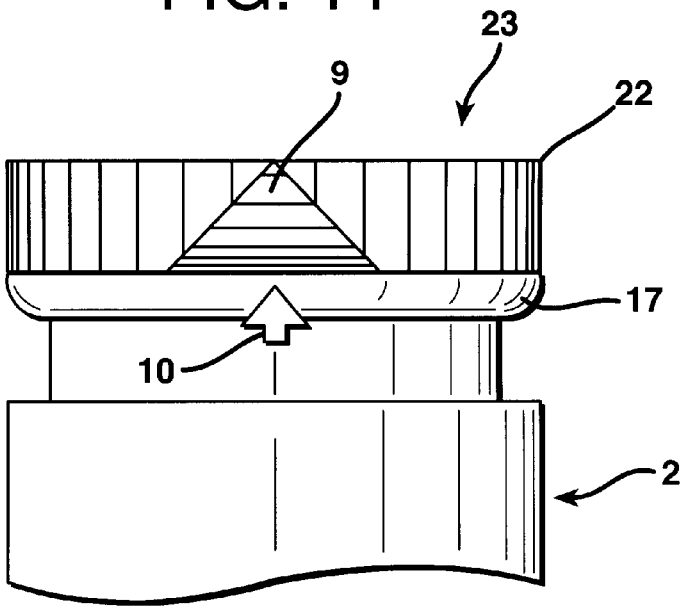
FIG. 14 is a front view of the cap and vial system of FIG. 13 in the inverted or non-child resistant position.
Figure 15:
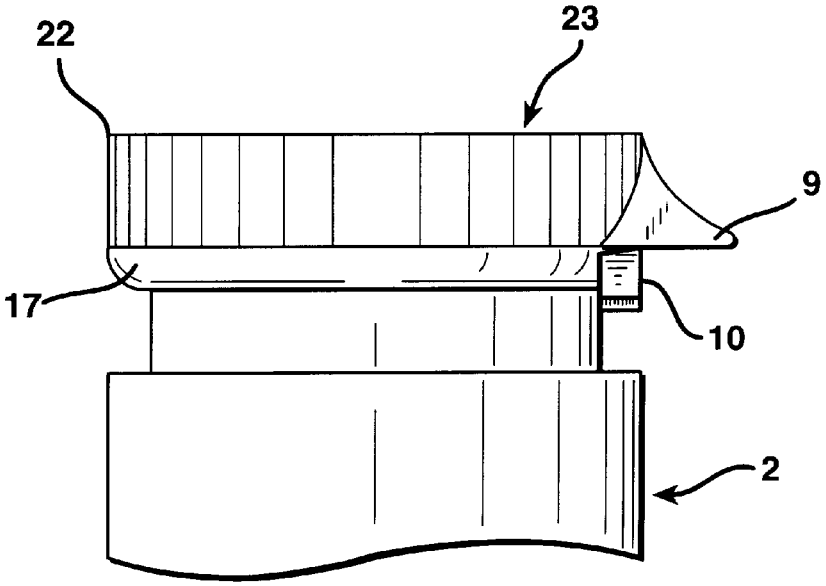
FIG. 15 is a side view of the system of FIG. 14.
Figure 17:
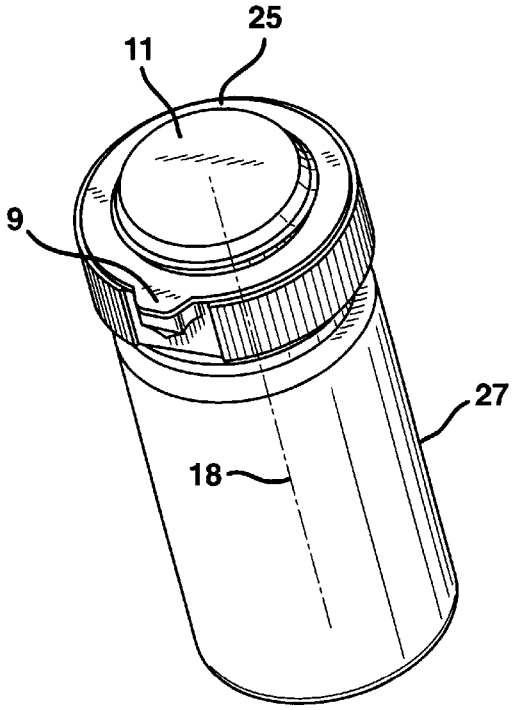
FIG. 17 is a perspective view of the CR side of the fourth embodiment of a reversible CR/NCR closure attached to the fourth embodiment of a vial.
Figure 20:
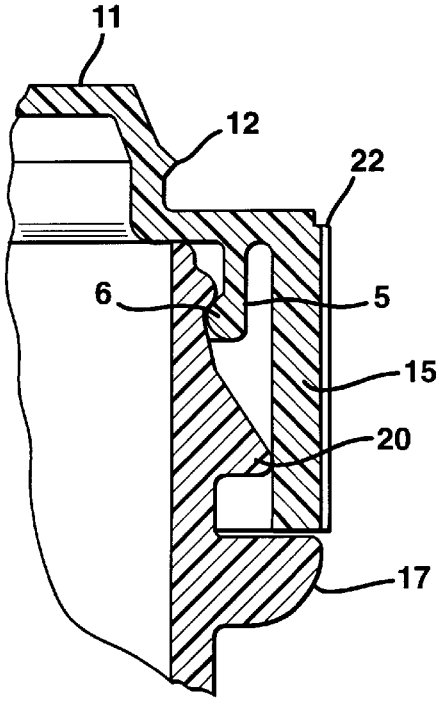
FIG. 20 is a detail view of the inset portion of FIG. 19.
Figure 18:
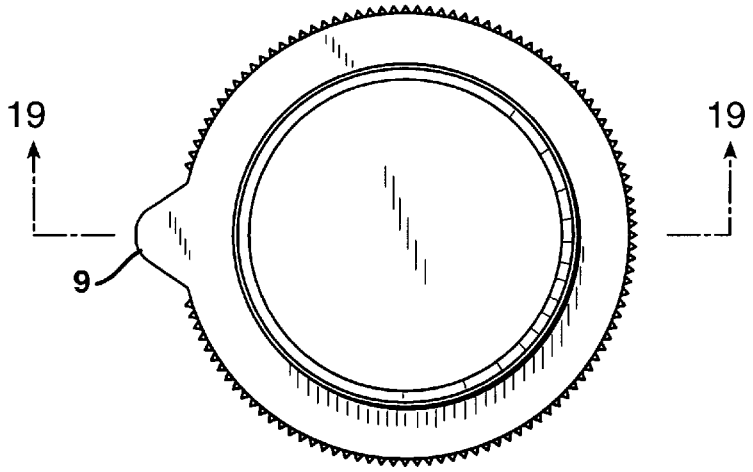
FIG. 18 is a top view of the closure and vial of FIG. 17.
Figure 19:
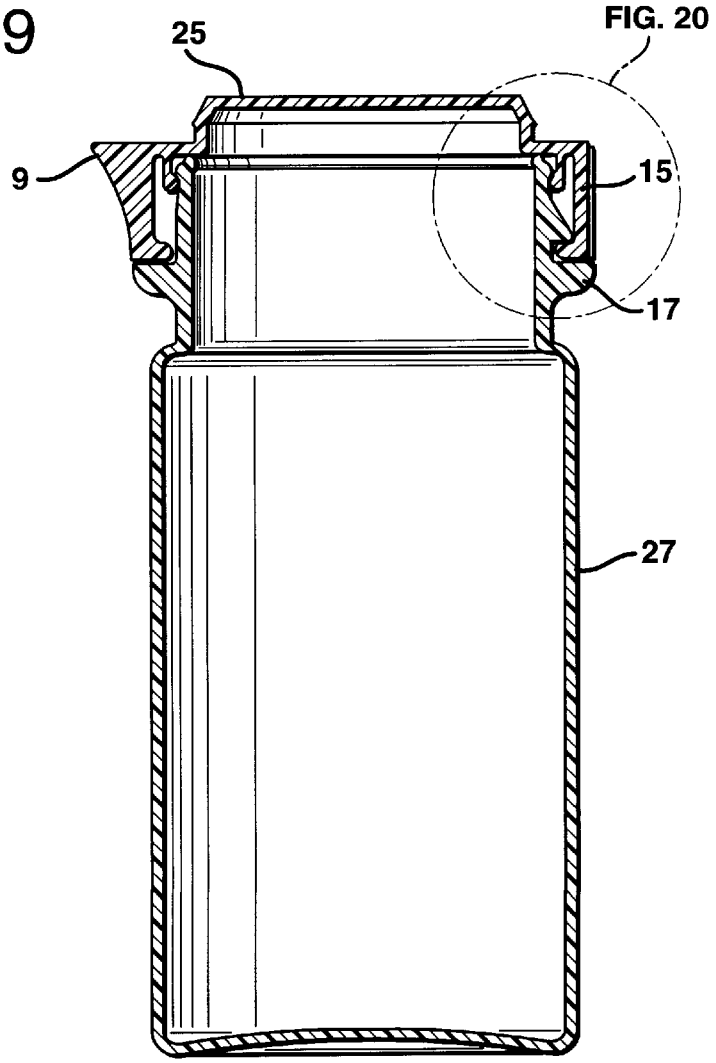
FIG. 19 is a cross sectional view taken along line 19—19 of FIG. 18.
Figure 21:
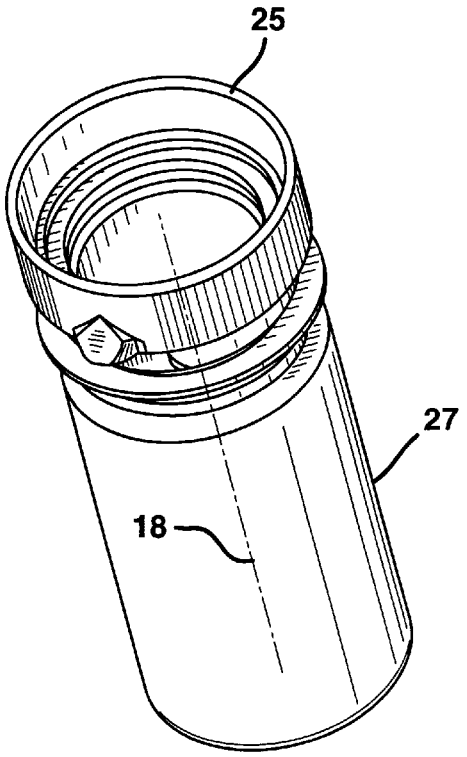
FIG. 21 is a perspective view of the NCR side of the fourth embodiment of a reversible CR/NCR closure attached to the fourth embodiment of a vial.
Figure 24:
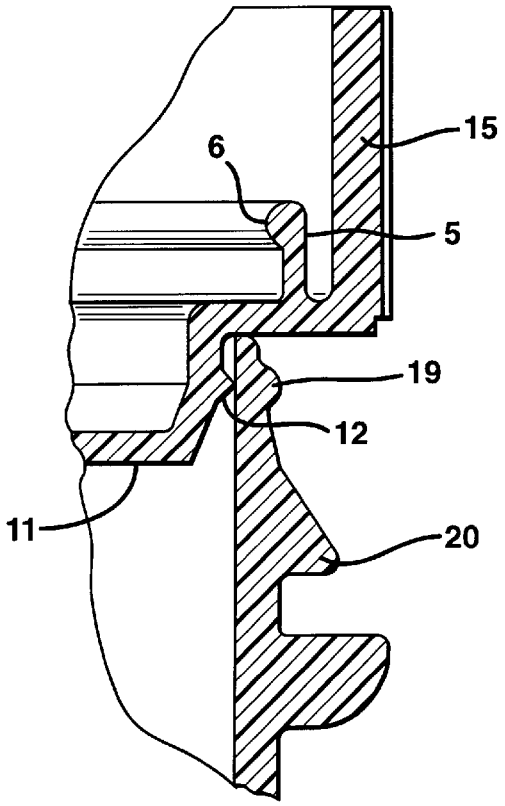
FIG. 24 is a detail view of the inset portion of FIG. 23.
Figure 22:
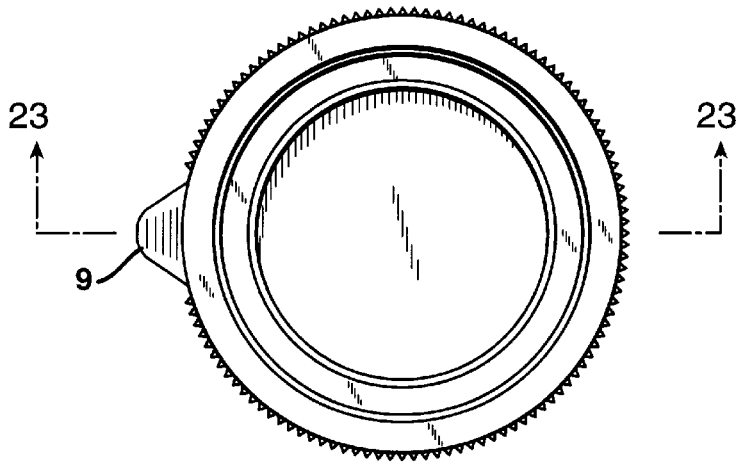
FIG. 22 is a top view of the closure and vial of FIG. 21.
Figure 23:
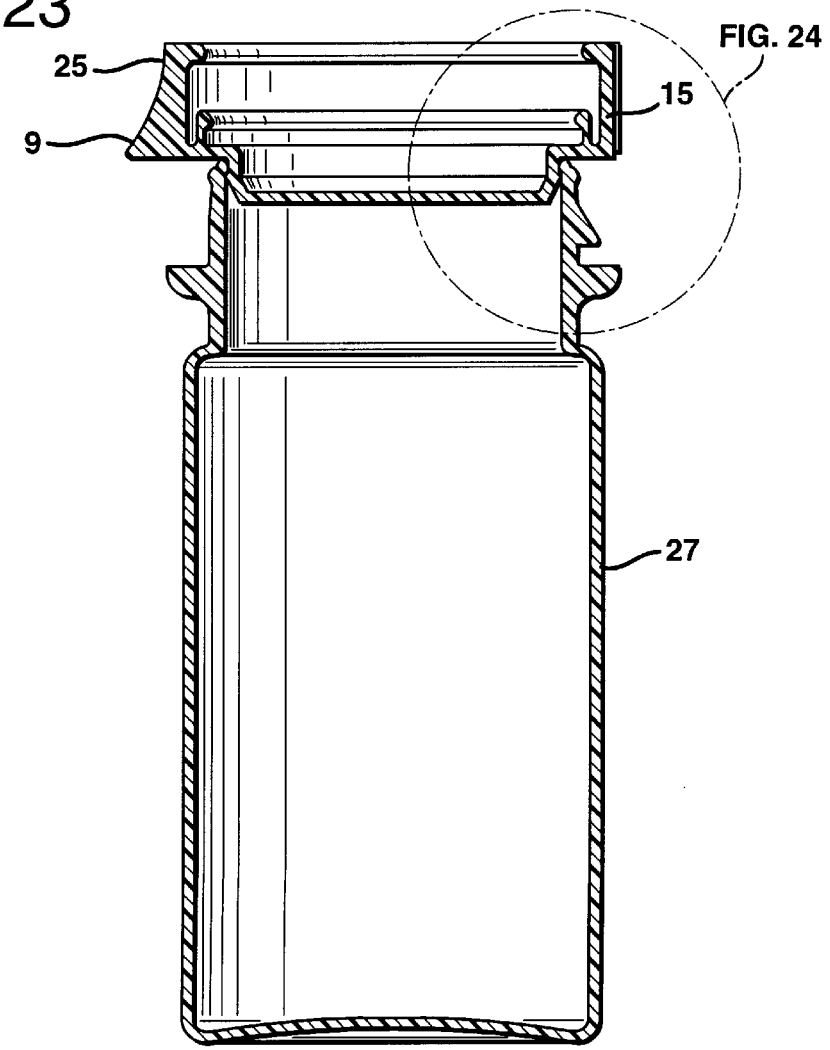
FIG. 23 is a cross sectional view taken along line 23—23 of FIG. 22.

In FIG. 11 and FIG. 12, the cap is in the child-resistant configuration, but it is not in the locked, child-resistant position since the cap tab and vial reference mark are in alignment. The non-child resistant portion of the cap extends above the tab and knurled circumferential exterior cap wall. In FIG. 13, the inner skirt and outer skirt are shown extending above the vial. A seal is formed on the interior neck wall of the vial by the retaining bead 12 and inner annular neck bead 7. The dome is preferably sized to fit snugly inside the vial mouth and neck when the cap is inverted and placed upside-down on top of the container. The dome may have a circular concentric retaining bead 12 around its circumference which, when placed inside the neck 13 of the container, snaps into place over the same inner annular neck bead 7 used to seat the inner skirt bead 6 of the cap in the child-resistant configuration. The dome rises to a height sufficient to displace the retaining bead 12 so that when it is in the NCR configuration, the retaining bead 12 extends as far down the neck as necessary to engage the inner annular neck bead 7. The retaining bead 12 preferably forms a moisture-impeding seal with the inner annular neck bead 7. The retaining bead 12 retains the closure on the vial when the closure is in the NCR configuration.

When us ed in this manner, the cap is no longer child-resistant. Users who do not require child-resistant functionality will accordingly find the cap is easier to use. The one-piece cap is reversibly child-resistant and non-child-resistant. The cap is designed to appear differently, e.g., having a higher profile, when placed in the non-child-resistant configuration, alerting the user visually that the package is not being used in its child-resistant configuration.

Figure 16:
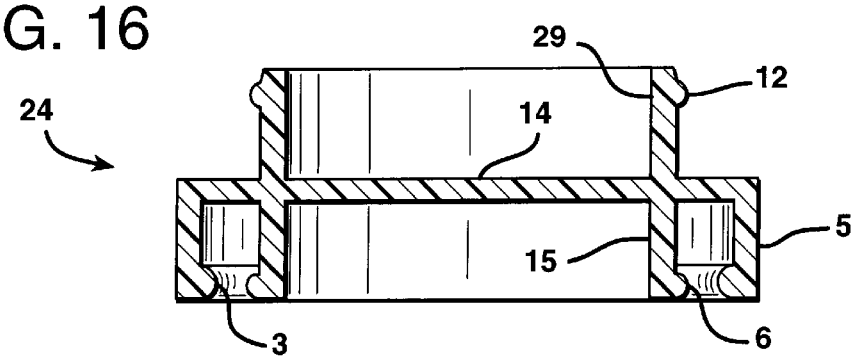
FIG. 16 is a section view of the third embodiment of the reversible child-resistant/non-child resistant closure.

FIG. 16 shows another CR/NCR reversible closure, the third embodiment closure 24. The third embodiment closure 24 is similar to the second embodiment closure 23. For example, the CR side of the two closures 23, 24 and manners of use are the same. A difference between the second and third embodiments of the closure is the location of end wall 14. As shown in FIG. 13, the end wall 14 of the second embodiment closure is near the top of the closure adjacent to the retaining bead 12. In contrast, as shown in FIG. 16, the end wall 14 of the third embodiment closure is medially located between the ends of the closure. Accordingly, in the third embodiment closure, the structure for displacing the retaining bead 12 at the desired height is the upstanding circumferential wall portion 29 rather than dome 11 defined by both an upstanding wall and an end wall near the top of the closure.

As with closure 23, the child resistant configuration can be obtained by snapping the closure onto the vial neck and rotating the closure 24 so that the gate and gate opening are out of alignment. As before, this is most easily accomplished by placing the vial reference mark 10 and tab 9 out of alignment because the reference mark and tab are preferably adjacent to the gate opening on the vial neck and the gate on the closure, respectively. The closure can be removed from the vial by aligning the thumb tab and reference mark, applying an upward axial pressure to the tab, and thereby popping of the closure from the vial. The closure and vial system of the third embodiment can be used in the NCR configuration by simply reversing the closure, inserting the NCR side having the retaining bead 12 into the vial mouth, and gently pressing down to engage the retaining bead 12.

The fourth embodiment will now be described with reference to FIG. 17–FIG. 34. FIG. 17–FIG. 20 are various views of the reversible CR/NCR closure 25 and vial 27 attached together in the non-locking orientation of the CR configuration. The manner of using the fourth embodiment closure and vial in the CR configuration is similar to that described previously in relation to the first, second, and third embodiments of the closure. That is, the CR side of the closure 25 is placed on the vial neck so that the locking lugs 16 and gate 8 ride over the lower annular neck bead 20 and snap into place underneath the bead 20. The closure may then be rotated, if necessary, to insure that the gate and gate opening are not in alignment. Since the tab 9 and reference mark 10 are preferably adjacent to the gate and gate opening, respectively, the CR position may be attained by placing the tab and reference mark out of alignment. The closure is removed as described previously.

In the fourth embodiment, by placing the closure in the CR configuration, a moisture-impeding seal is formed between upper annular neck bead 19 located on the vial neck and inner skirt bead 6 located on skirt 5. Preferably, the upper annular neck bead 19 and inner skirt bead 6 are endless annular beads.

FIG. 21–FIG. 24 are various views of the reversible CR/NCR closure 25 and vial 27 attached together in the non-locking orientation of the NCR configuration. The NCR side of the closure 25 is structurally similar to the NCR side of the second embodiment closure 23 and is used in a similar manner. In this embodiment, the retaining bead 12 is preferably an endless annular bead adapted to fit snugly up against the radially inwardly facing wall of the neck thereby forming a moisture-impeding seal.

Figure 25:
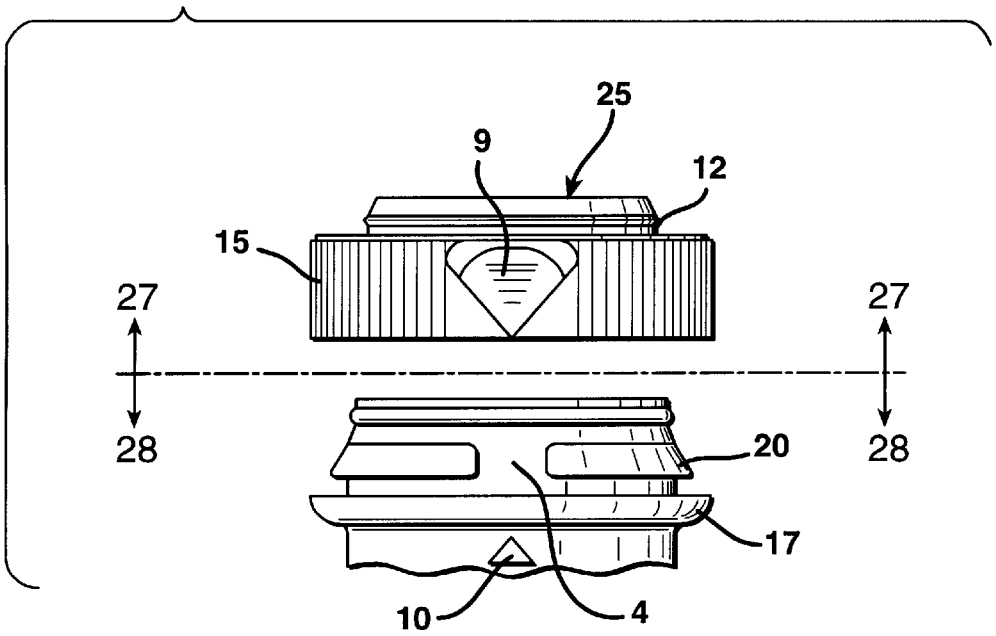
FIG. 25 is a frontal view of the fourth embodiment of the reversible CR/NCR closure separated from the fourth embodiment vial neck oriented in a non-locking orientation.

FIG. 25 is a frontal view of the fourth embodiment of the reversible CR/NCR closure 25 separated from the neck of vial 27. The portion of the vial below the neck region is not shown for clarity. The closure gate is preferably situated adjacent to and directed radially inwardly from the thumb tab 9 on the outer skirt 15. As shown in FIG. 25, insofar as the closure gate 8 (not shown in FIG. 25, shown in FIG. 27) is substantially vertically aligned with the gate opening 4, the closure and vial neck are rotationally oriented in the non-locking orientation. As will be readily apparent to the skilled artisan, the thumb tab facilitates orienting (e.g., rotating) the closure while it is located on the vial in either the CR or NCR configuration. The thumb tab 9 also facilitates removing the closure from the non-locking orientation of the CR configuration.

The neck finish of the vial preferably includes an upper annular neck bead 19 and a lower annular neck bead 20 having a gate opening 4 for receiving the closure gate 8. Preferably, the neck finish includes a flange 17 upon which the closure outer skirt 15 may rest while in the CR configuration. Preferably, a reference mark 10 for locating the position of the gate opening is provided on the vial near the neck, preferably along or below the flange 17.

Any of the embodiments of the closure preferably includes circumferential knurlments 22 disposed along a substantial portion of the outer skirt. The fourth embodiment of the closure 25 may include an upstanding dome 11 having means disposed thereon for engaging the vial in a NCR manner, such as an annular retaining bead 12 of the fourth embodiment, or a spiral (threaded) retaining bead 21, as in the fifth embodiment of the closure 26 shown in FIG. 35–FIG. 36.

Figure 26:
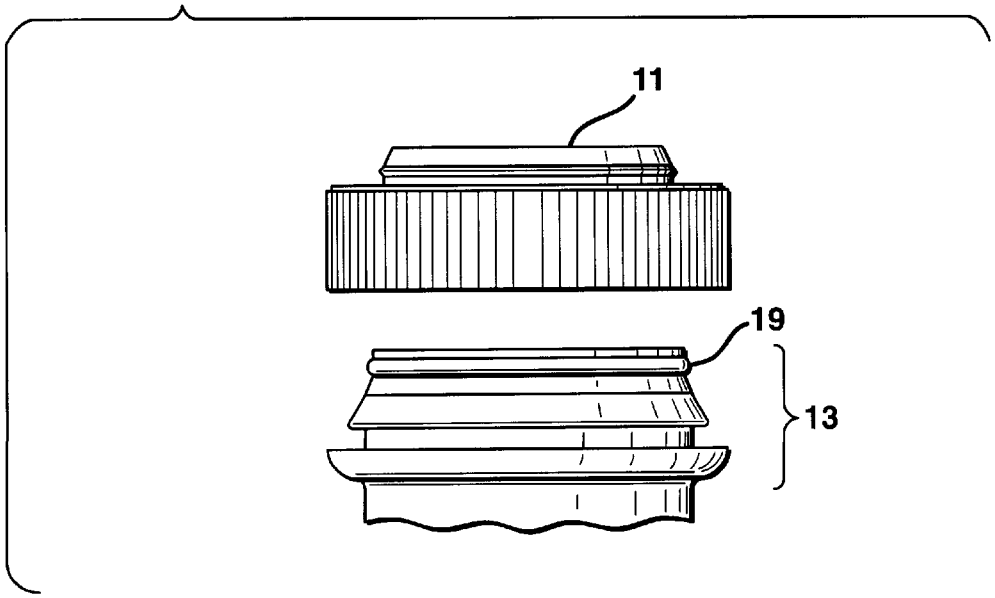
FIG. 26 is a rear view of the closure and vial neck shown in FIG. 25.

FIG. 26 is a rear view of the fourth embodiment closure 25 and vial neck finish shown in FIG. 25. As indicated, the lower annular neck bead 20 of the vial neck finish is discontinuous in that a gate opening 4 is provided, as shown in FIG. 25. Preferably, the upper annular neck bead 19 is continuous to provide better moisture barrier properties.

Figure 27:
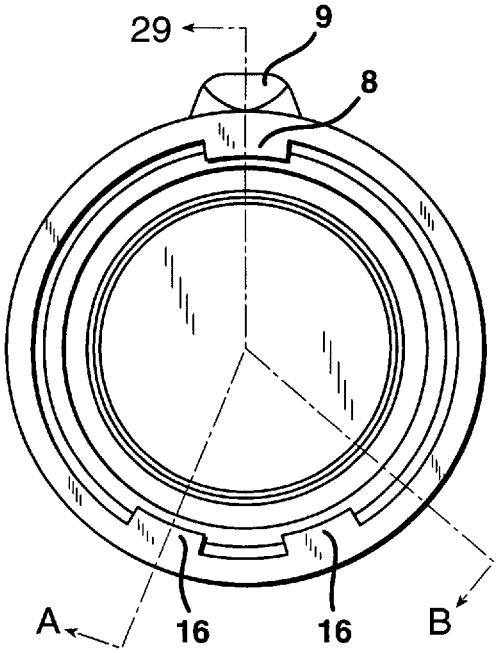
FIG. 27 is a view of the CR side of the closure taken along view 27—27 of FIG. 25.

FIG. 27 is a view of the CR side of the fourth embodiment closure taken along line 27—27 of FIG. 25. Optional knurlments 22 are shown. Gate 8 is preferably generally aligned with the thumb tab. Any desired number of locking lugs, such as two, are situated generally opposite the gate. The locking lugs 16 are preferably situated close enough together so as not to bind the closure to the vial when the gate 8 is aligned with the gate opening 4 and upward force is applied to the thumb tab to remove the closure from the vial. Preferably, the angle formed between the gate and each locking lug is an obtuse angle. More preferably, the angle is 135°–180°. Most preferably, the angle is 160°–180°. If only one locking lug is provided, preferably it is located at an angle of about 160°–180° apart from the gate, most preferably at about 180°. For the purposes of this disclosure, the theoretical maximum angle between a gate and a locking lug is 180°. Accordingly, a "200°" angle between a gate and a locking lug is the same as a 160° angle.

Figure 28:
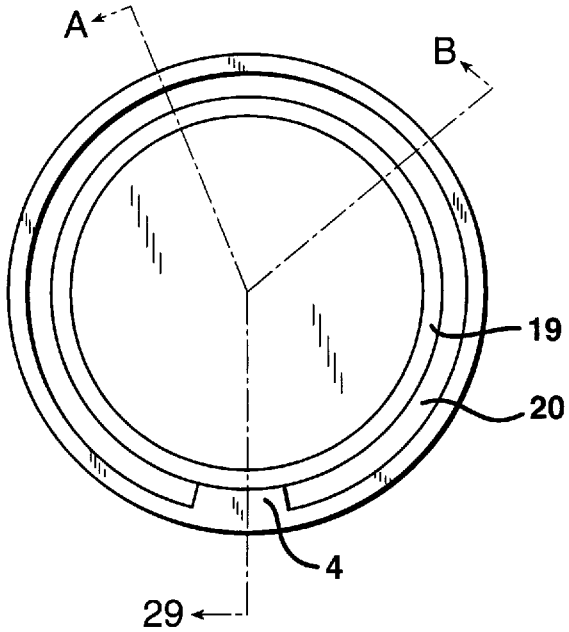
FIG. 28 is a top view of the vial taken along view 28—28 of FIG. 25.

FIG. 28 is a top view of the vial taken along line 28—28 of FIG. 25. The upper annular neck bead 19, lower annular neck bead 20, and gate opening are shown. The gate 8 on the closure fits into the gate opening 4 on the vial neck when the CR side of the closure is situated in the non-locking orientation on the vial neck.

Figure 29A:
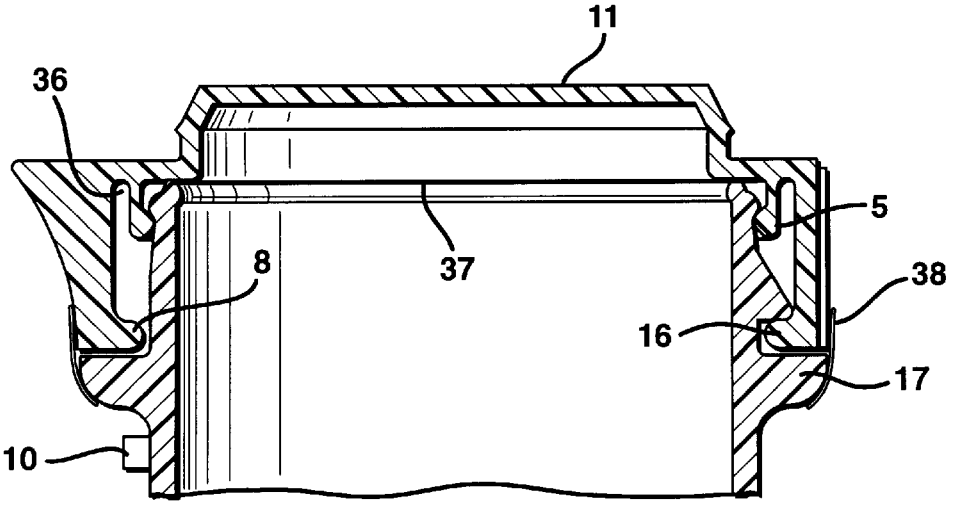
FIG. 29A is a cross sectional view of the closure and vial neck in the non-locking orientation of the CR configuration taken along line 29-A of FIG. 27 and line 29-A of FIG. 28.
Figure 29B:
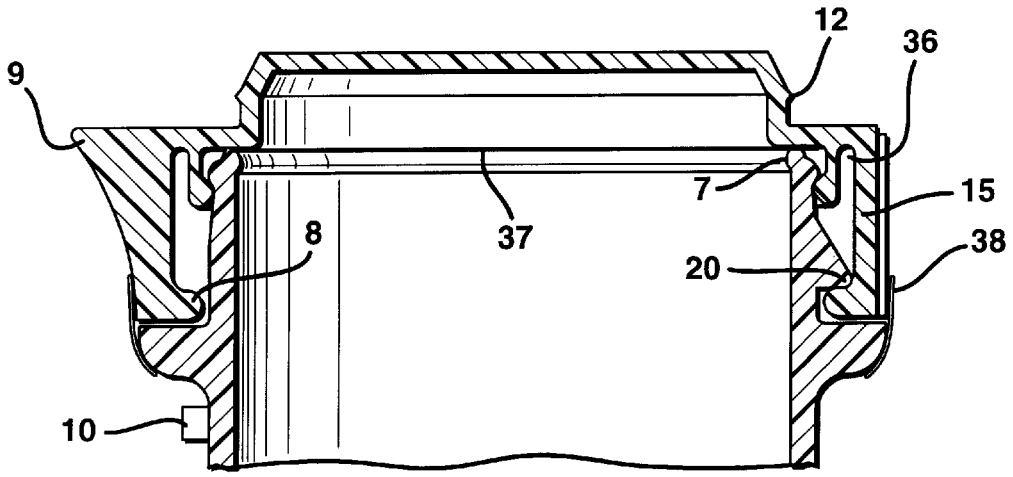
FIG. 29B is a cross sectional view of the closure and vial neck in the non-locking orientation of the CR configuration taken along line 29-B of FIG. 27 and line 29-B of FIG. 28.

FIG. 29A is a cross sectional view of the closure and vial neck in the non-locking orientation of the CR configuration taken along line 29-A of FIG. 27 and line 29-A of FIG. 28. FIG. 29B is a cross sectional view of the closure and vial neck in the non-locking orientation of the CR configuration taken along line 29-B of FIG. 27 and line 29-B of FIG. 28. The closure may include thumb tab 9, dome 11, retaining bead 12, outer skirt 15, gate 8, locking lugs 16, inner skirt 5, and inner skirt bead 6. The vial neck may include reference mark 10, flange 17, lower annular neck bead 20, upper annular neck bead 19, and optional inner annular neck bead 7.

Also shown is tamper-evident barrier film 37 sealed across the vial mouth. As is known in the art, the barrier film 37 may be induction heat sealed to the vial neck. Also shown is optional tamper-evident shrink-wrap film 38 sealed across the juncture between the cap and vial.

Figure 30:
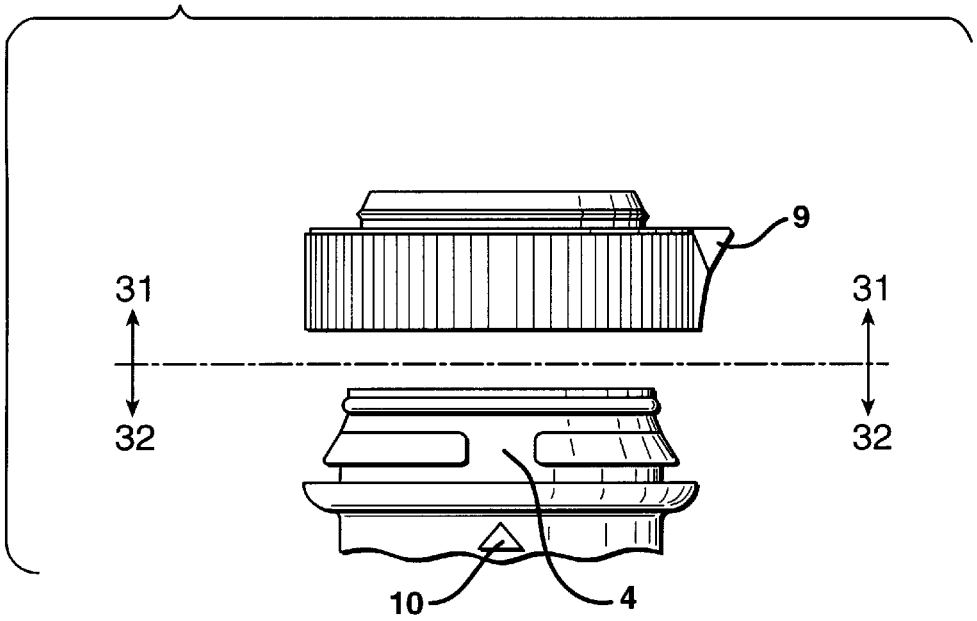
FIG. 30 is a frontal view of the fourth embodiment of the reversible CR/NCR closure separated from the vial neck oriented in a locking orientation.

FIG. 30 is a frontal view of the fourth embodiment of the reversible CR/NCR closure separated from the vial neck 13. Insofar as the gate 8 is not substantially vertically aligned with the gate opening 4, FIG. 30 shows the closure and vial neck positioned in a locking orientation. As shown in FIG. 30, the closure is rotated about one quarter-rotation relative to its position shown in FIG. 25. Accordingly, the gate is similarly rotated about 90° relative to the gate opening 4.

Figure 31:
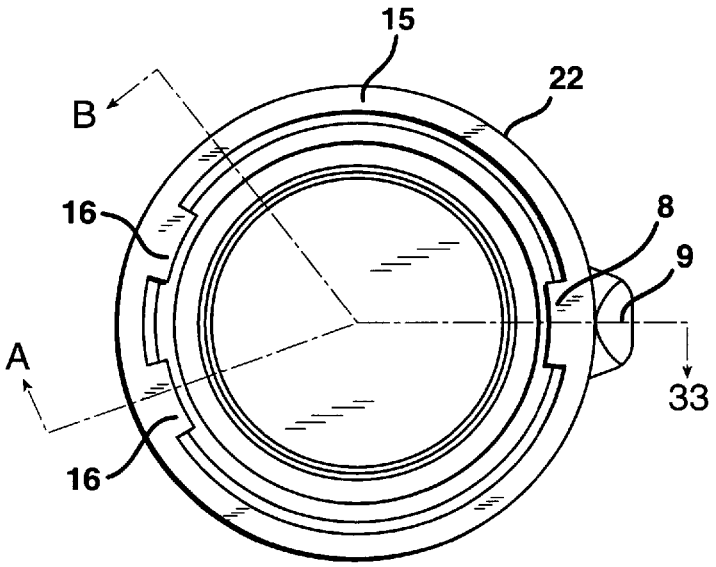
FIG. 31 is a view of the CR side of the closure taken along view 31—31 of FIG. 30.

FIG. 31 is a view of the CR side of the closure taken along line 31—31 of FIG. 30. The optional knurlments 22, outer skirt 15, locking lugs 16, gate 8, and thumb tab 9 are shown.

Figure 32:
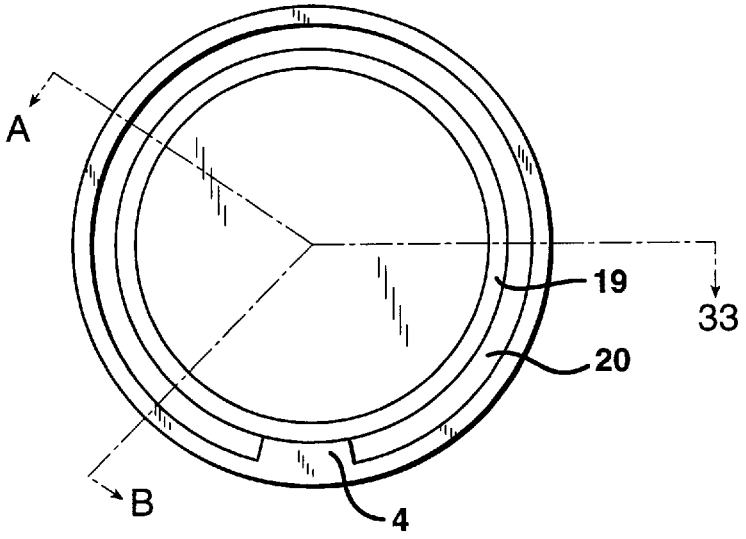
FIG. 32 is a top view of the vial taken along view 32—32 of FIG. 30.

FIG. 32 is a top view of the vial taken along line 32—32 of FIG. 30. The upper annular neck bead 19, lower annular neck bead 20, and gate opening 4 are shown.

Figure 33A:
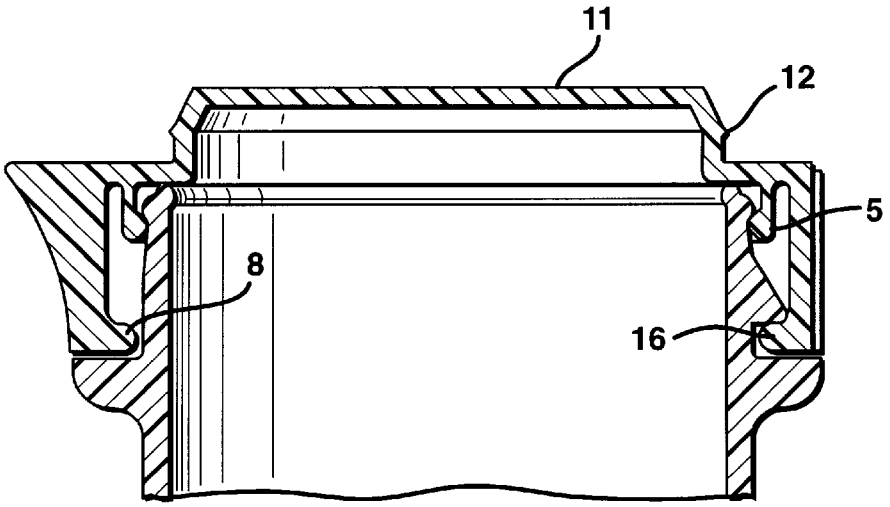
FIG. 33A is a cross sectional view of the closure and vial neck in the locking orientation of the CR configuration taken along line 33-A of FIG. 31 and line 33-A of FIG. 32.
Figure 33B:
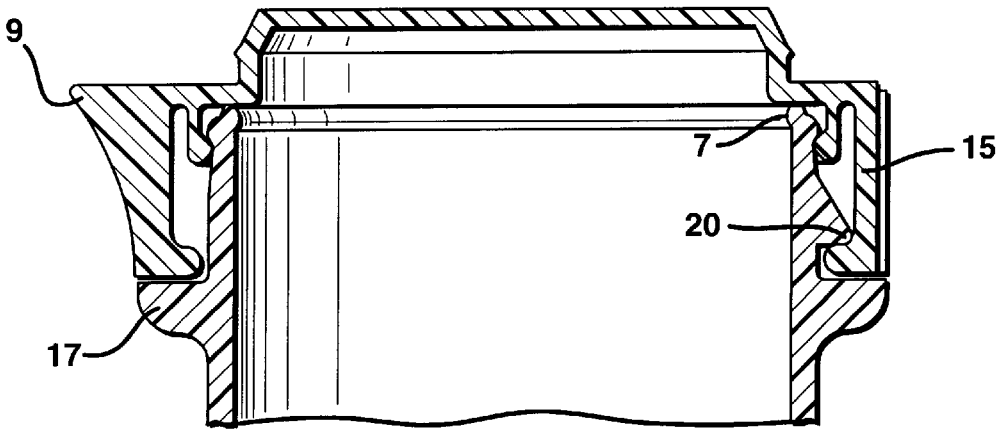
FIG. 33B is a cross sectional view of the closure and vial neck in a locking orientation of the CR configuration taken along line 33-B of FIG. 31 and line 33-B of FIG. 32.

FIG. 33A is a cross sectional view of the fourth embodiment closure 25 and vial neck in the locking orientation of the CR configuration taken along line 33-A of FIG. 31 and line 33-A of FIG. 32. FIG. 33B is a cross sectional view of the closure and vial neck in a locking orientation of the CR configuration taken along line 33-B of FIG. 31 and line 33-B of FIG. 32. As in FIG. 29A and 29B, the closure includes thumb tab 9, dome 11, retaining bead 12, outer skirt 15, gate 8, locking lug 16, and inner skirt 5. The vial neck shown in FIG. 33A and FIG. 33B includes flange 17, lower annular neck bead 20, upper annular neck bead 19, and optional inner annular neck bead 7. Reference mark 10 cannot be seen in FIG. 33B since the gate 8 is not aligned with the gate opening 4 in the locking orientation.

Figure 34:
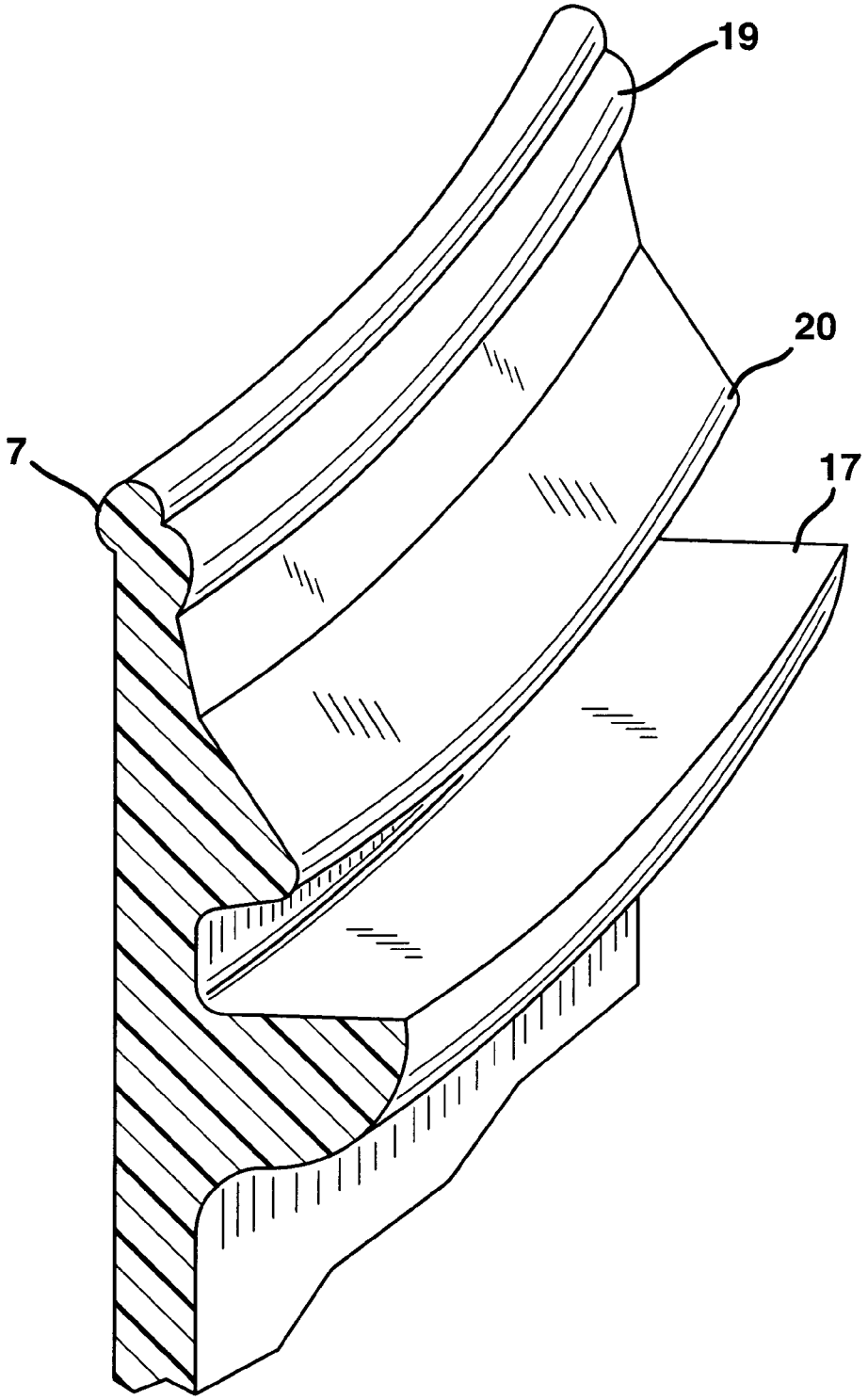
FIG. 34 is a partial perspective view of the outward facing side of the vial neck shown in FIG. 30.

FIG. 34 is a partial perspective view of the outward facing side of the vial neck finish. The figure shows the optional inner annular neck bead 7, upper annular neck bead 19, lower annular neck bead 20, and flange 17.

Preferably, the optional inner annular neck bead 7 and upper annular neck bead 19 are continuous along the entire vial neck circumference. Preferably, the lower annular neck bead 20 is interrupted only by the gate opening 4 for receiving the closure gate 8. Preferably, the closure locking lugs 16 snap-fit over the lower annular neck bead 20. Optionally, however, additional openings in the lower annular neck bead 20 could be provided to accommodate or receive one or more locking lugs 16 when the closure and vial are oriented in the non-locking orientation (not shown).

Figure 35:
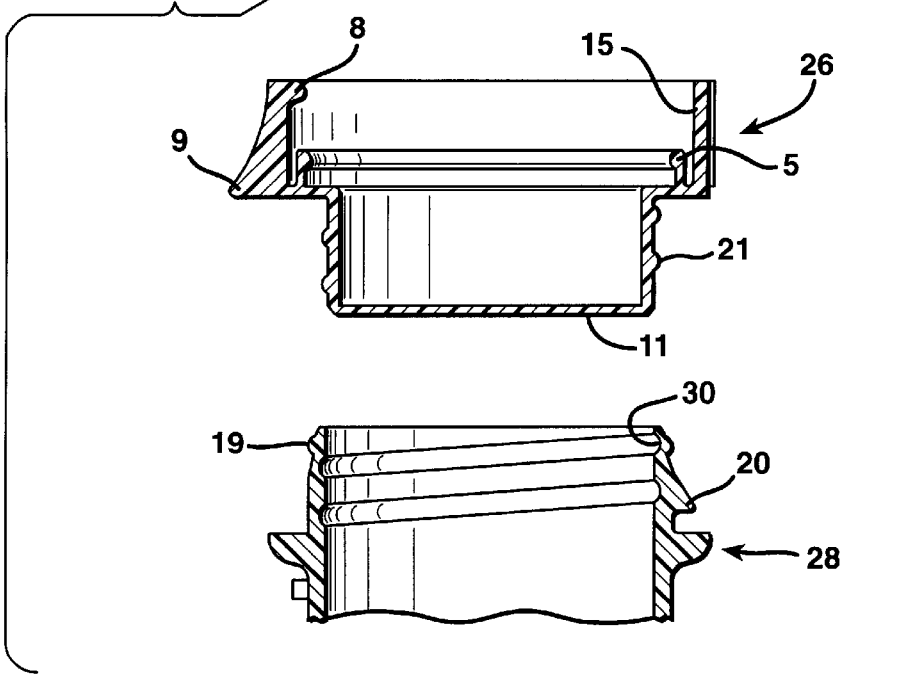
FIG. 35 and FIG. 36 show the fifth embodiment of the reversible CR/NCR closure having a double-thread screw cap dome and vial neck inner wall having corresponding grooves for receiving the threaded beads.
Figure 36:
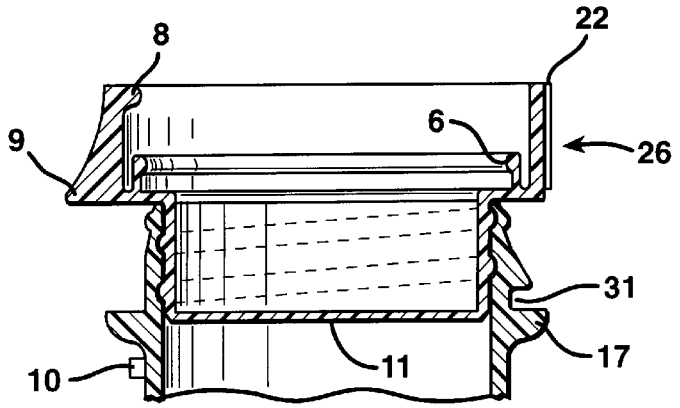

FIG. 35 and FIG. 36 show a fifth embodiment of the reversible CR/NCR closure and vial system. In the fifth embodiment closure 26, the annular retaining bead 12 is replaced by a threaded bead 21, such as a double-thread bead as shown. A complementary groove 30 could be provided in the radially inwardly facing surface of the corresponding neck of the fifth embodiment vial 28 to receive the threaded bead 21 of the closure dome, as shown in FIG. 36. Preferably, the thread is a conventional right-handed thread.

Alternatively, the radially inwardly facing surface of the neck of the fifth embodiment vial 28 could be provided with a threaded bead (not shown) instead of a groove. Such a threaded bead would preferably be situated slightly above the closure threaded bead as depicted in FIG. 36. Alternatively, the closure dome could be provided with a groove and the vial neck provided with a complementary threaded bead.

The closure is preferably injection molded. The vial is preferably blow molded. The level of skill in the molding art is such that the skilled artisan would be able to make the closure and vial structures described herein without undue experimentation. Preferably, both the closure and vial are each made of integral one-piece construction.

The closure and vial may be closed together into the locked, CR configuration as follows. The CR side of the closure may be pressed together by hand with the vial neck in a well known manner. If the gate or any of the locking lugs do not happen to be aligned with the gate opening, then the outer skirt 15 simply flexes to allow the gate 8 and locking lugs 16 to ride over the lower annular neck bead and snap into position below the lower annular neck bead. The locking orientation is achieved by rotating the closure with respect to the vial neck so that the gate and gate opening are not in vertical alignment. This desired, locking, misalignment is most easily observed by noting the misalignment of the thumb tab 9 and the reference mark 10 on the vial. The reference mark preferably marks the location of the center of the gate opening. The thumb tab preferably marks the location of the gate.

To release the closure from the vial, the closure and vial neck are rotated with respect to one another to bring the gate and gate opening into alignment. This alignment is accomplished most advantageously by aligning the thumb tab with the reference mark. Subsequently, an axial separation force is applied to the thumb tab away from the vial. The gate end of the closure separates from the vial neck and the locking lugs are released from the neck groove defined by the lower annular neck bead 20 and flange 17.

The NCR side of the closure may be used whenever child resistance is not desired. The first embodiment of the closure cap employs a "snap-fit" annular retaining bead 12 which is pressed inside the vial mouth or over the optional inner annular neck bead 7 on the inside surface of the vial neck. The NCR side of the closure is removed from the vial neck by applying an axial separation force to the closure away from the vial while restraining the vial without consideration of the rotational orientation of the gate with respect to the gate opening.

As shown in FIG. 35–FIG. 36, the fifth embodiment of the closure and vial neck employs one or more threaded retaining beads to permit a NCR screw-type closure. In a well known manner, the threaded NCR side of the closure is screwed into the vial neck to close, and unscrewed to remove the closure from the vial.

While the preferred embodiments incorporate a dome having an annular bead, or in the alternative, threaded retaining beads (double or single) to secure the reversible CR/NCR closure to the vial when child resistance is not desired, the skilled artisan will recognize that other structures are capable of achieving acceptable NCR attachment of the closure to the vial. The scope of the invention is not limited to the specific embodiments shown above.

Furthermore, in one further aspect of the invention, the closure need not be reversible between a CR and a NCR configuration. That is, one aspect of the invention is a CR closure that does not require a dome or means for providing NCR closure capability.

Preferably, the closure is linerless, but liners may be provided if desired. The closure is preferably made from a plastic material, such as high density polyethylene (HDPE). The vial is also preferably made from a plastic material, such as low density polyethylene (LDPE). The skilled artisan, having the benefit of the instant disclosure, will readily appreciate that the closures and vials may be made from other suitable materials.

The closure and vial system of the first, second, and third embodiments, can be used in situations where a tamper evident film seal is not required across the vial mouth, as in a pharmacy dispensing prescription drugs. The closure and vial system of the fourth and fifth embodiments, however, can readily adopt a seal across the mouth of the vial after vial filling operation because the CR side of the closure does not include structures which extend down into the vial mouth. Accordingly, the fourth and fifth embodiment systems can be used in over-the-counter consumer drug packaging as well as in prescription drug dispensing.

Figure 38:
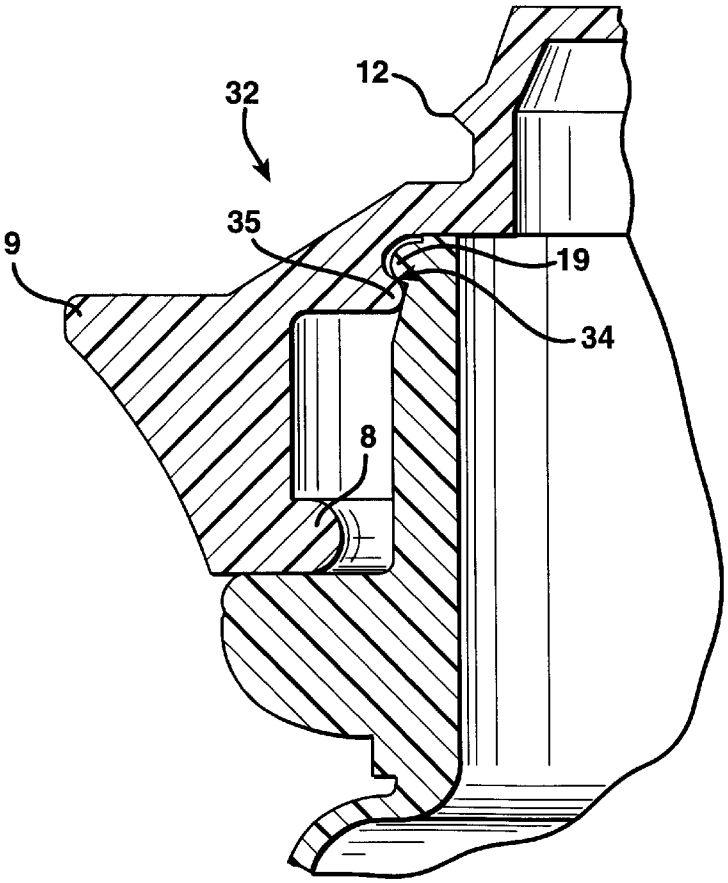
FIG. 37 and FIG. 38 are detail views of the seal area of a closure in the non-locking orientation.
Figure 37:
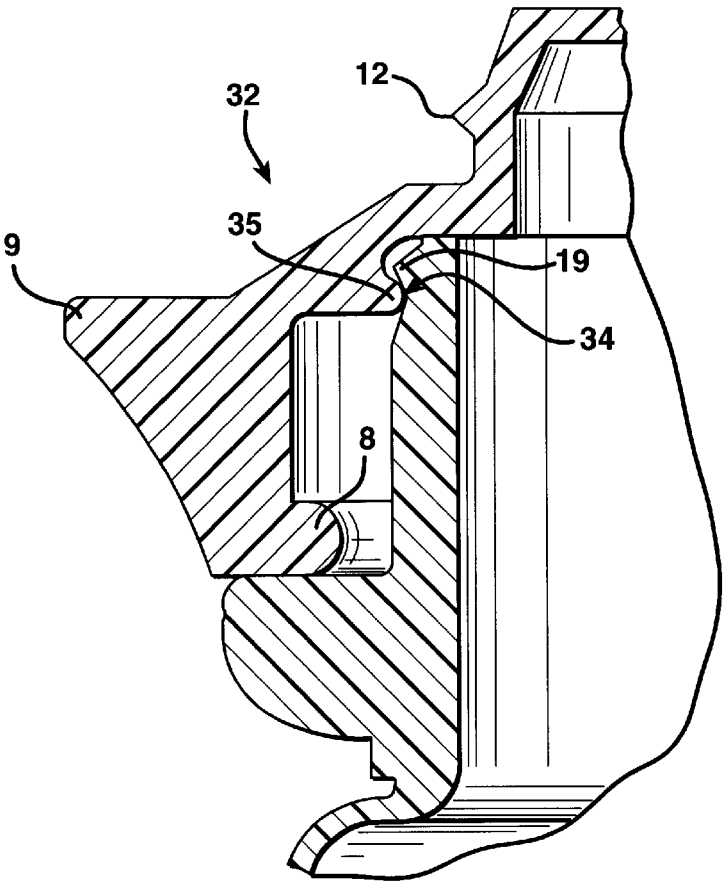

FIG. 37 and FIG. 38 show a preferred sixth embodiment form of the closure and neck. Upper annular neck bead 19 is shown forming an upper seal 34 with an upper skirt bead 35 on outer skirt 15. Upper skirt bead 35 is preferably an endless annular bead extending completely around the closure's central axis. Similarly, as in the previously described embodiments, the upper annular neck bead is also preferably an endless annular bead extending completely around the neck's central axis. The radius of the upper annular neck bead is preferably small enough so that the gate 8 can pass over the upper annular neck bead without requiring an opening similar to the gate opening 4 in the lower annular neck bead.

In one respect, the sixth embodiment closure 32 shown in FIG. 37 and FIG. 38 differs from that of the fourth and fifth embodiments, shown for example in FIG. 29B and FIG. 35, respectively, in that the upper skirt bead 35 forms a part of the outer skirt rather than being located on a separate inner skirt. As shown in FIG. 29A and FIG. 29B, the skirt trough 36 separates and thereby partially defines the inner skirt 5 and outer skirt 15 as separated structures. The skirt trough 36 enables the inner skirt 5 to flexibly conform to the contour of the upper annular neck bead 19. It is believed that omission of a skirt trough from the closure, as shown in the sixth embodiment depicted in FIG. 37 and FIG. 38, will facilitate removal of the closure from the mold.

In the fourth, fifth, and sixth embodiment vials, the upper annular neck bead 19 may include a cusped contour (as shown in FIG. 37) or a more arcuate contour (as shown in FIG. 38).

The drawings show the following structural features of the instant invention:

1—closure, first embodiment
2—vial, first, second, and third embodiments
3—outer neck bead
4—gate opening
5—inner skirt
6—inner skirt bead
7—inner annular neck bead
8—gate
9—tab
10—reference mark
11—dome
12—retaining bead
13—vial neck
14—end wall
15—outer skirt
16—locking lugs
17—flange
18—rotational axis
19—upper annular neck bead
20—lower annular neck bead
21—threaded retaining bead
22—knurlments
23—closure, second embodiment
24—closure, third embodiment
25—closure, fourth embodiment
26—closure, fifth embodiment
27—vial, fourth embodiment
28—vial, fifth embodiment
29—upstanding circumferential dome wall
30—dome groove
31—neck groove
32—closure, sixth embodiment
33—inner wall surface of outer skirt
34—upper seal
35—upper skirt bead
36—skirt trough
37—tamper-evident barrier film
38—tamper-evident shrink-wrap film

What is claimed is:

1. A child resistant closure and container system comprising:

(a) a closure having
  1) a first downwardly depending skirt on which is located a first annular closure bead,
  2) an endless annular closure snap bead, and
  3) a projection extending radially inwardly from said first skirt; and (b) a container having a mouth defined by a neck on which are located
  1) a first annular neck bead defining an opening for receiving said projection, and
  2) an endless annular neck snap bead, wherein, when said closure and container are joined together in a child resistant configuration, at least a portion of said first closure bead underlies said first neck bead and said endless closure snap bead snaps over said endless neck snap bead to form a moisture-impeding seal.

2. The system of claim 1 wherein said endless closure snap bead is on said first skirt.

3. The system of claim 1 wherein said closure is linerless.

4. The system of claim 1 wherein said closure is molded from high density polyethylene.

5. The system of claim 1 wherein said first closure bead includes at least two locking lugs.

6. The system of claim 1 wherein said closure further comprises a second downwardly depending skirt and said endless closure bead is on said second skirt.

7. The system of claim 1 wherein said second skirt is positioned at a smaller radius than said mouth and extends into said mouth.

8. The system of claim 1 wherein said closure includes a tab portion extending radially outwardly from a body portion of said closure a distance of from about 2 to about 6 mm and circumferentially along the body portion from about 4 to about 15 mm.

9. The system of claim 8 wherein said tab portion extends radially outwardly from the body portion a distance of about 4 mm and circumferentially along the body portion at least about 6 mm.

10. The system of claim 1 wherein said container further comprises a container alignment mark and said closure includes a referencing structure whereby the rotational alignment of said alignment mark and said referencing structure corresponds to rotational alignment of said projection and said opening.

11. The system of claim 10 where said referencing structure is a tab portion and said projection is located generally radially inwardly from said tab portion.

12. The system of claim 1 further including a tamper-evident barrier seal securely fastened across the mouth of said neck and a shrink-wrap tamper-evident film around said closure and neck.

13. The system of claim 12 further including a shrink-wrap tamper-evident film around at least a portion of said closure and container.

14. The system of claim 1 wherein said closure further comprises a second downwardly depending skirt and said endless closure snap bead is on said second skirt.

15. The system of claim 14 wherein said second skirt extends downwardly a shorter distance than does said first skirt.

16. The system of claim 14 further comprising a moisture barrier film sealed across said mouth.

17. The system of claim 1 wherein said closure further comprises:

a) a non-child resistant retaining bead displacement structure, the maximum diameter of which is slightly less than that of the mouth of said neck, extending in an axial direction opposite to that of said downwardly depending skirt; and b) a retaining bead on said displacement structure for frictional engagement with a radially inwardly facing surface of said neck.

18. The system of claim 17 wherein said retaining bead forms a moisture-impeding seal with said endless neck snap bead on said radially inwardly facing surface of said neck.

19. The system of claim 17 wherein said retaining bead is annular and extends around substantially all of said displacement structure.

20. The system of claim 17 wherein said non-child resistant retaining bead displacement structure includes an upstanding wall.

21. The system of claim wherein said non-child resistant retaining bead displacement structure is a dome.

22. The system of claim 17 wherein said retaining bead is a spiral threaded bead.

23. The system of claim 22 wherein said radially inwardly facing surface of said neck includes a spiral threaded groove capable of receiving said spiral threaded bead.

24. A child resistant closure for use with a container having an endless annular neck snap bead comprising:

(a) a first downwardly depending skirt on which is located a first annular closure bead;

(b) an endless annular closure snap bead; and (c) a projection extending radially inwardly from said first skirt;

wherein, when said closure and container are joined together in a child resistant configuration, said endless closure snap bead snaps over said endless neck snap bead to form a moisture-impeding seal.

* * * * *